US006453698B2

(12) United States Patent
Jain et al.

(10) Patent No.: US 6,453,698 B2
(45) Date of Patent: Sep. 24, 2002

(54) FLEXIBLE REFLUX PROCESS FOR HIGH NGL RECOVERY

(75) Inventors: Pallav Jain, Houston, TX (US); Rong-Jywn Lee, Sugar Land, TX (US); Jame Yao, Sugar Land, TX (US); Jong Juh Chen, Sugar Land, TX (US); Douglas G. Elliot, Houston, TX (US)

(73) Assignee: IPSI LLC, Houston, TX (US)

( * ) Notice: Subject to any disclaimer, the term of this patent is extended or adjusted under 35 U.S.C. 154(b) by 0 days.

(21) Appl. No.: 09/833,892

(22) Filed: Apr. 12, 2001

Related U.S. Application Data

(60) Provisional application No. 60/197,037, filed on Apr. 13, 2000.

(51) Int. Cl.[7] ..... F25J 3/02
(52) U.S. Cl. ..... 62/621; 62/643
(58) Field of Search ..... 62/620, 643, 621

(56) References Cited

U.S. PATENT DOCUMENTS 3,813,890 A * 6/1974 Bligh ..... 62/40
4,171,964 A 10/1979 Campbell et al.
4,251,249 A 2/1981 Gulsby
4,278,457 A 7/1981 Campbell et al.
4,507,133 A 3/1985 Khan et al.
4,596,588 A 6/1986 Cook
4,657,571 A 4/1987 Gazzi
4,687,499 A 8/1987 Aghili
4,690,702 A 9/1987 Paradowski et al.
4,851,020 A 7/1989 Montgomery, IV
4,895,584 A 1/1990 Buck et al.
5,568,737 A 10/1996 Campbell et al.
5,685,170 A 11/1997 Sorensen
5,771,712 A 6/1998 Campbell et al.
5,799,507 A 9/1998 Wilkinson et al.
5,890,378 A 4/1999 Rambo et al.
5,953,935 A 9/1999 Sorenson
6,116,050 A 9/2000 Yao et al.

* cited by examiner

*Primary Examiner*—William C. Doerrler
*Assistant Examiner*—Malik N. Drake

(57) ABSTRACT

A process for enhancing the recovery of less volatile components, from a multi component gas mixture, in a cryogenic distillation column, which involves withdrawing a stream from the cryogenic distillation column and processing it to yield a stream leaner in the component to be recovered, which will be cooled and fed to the cryogenic distillation column as a reflux. The processing step may include heating or cooling the side draw and then further contacting the side draw with another stream which is substantially condensed.

18 Claims, 4 Drawing Sheets

FLEXIBLE REFLUX PROCESS FOR HIGH NGL RECOVERY

This application claims the benefit of provisional application No. 60/197,037, field Apr. 13, 2000,

FIELD OF INVENTION

The present invention is directed towards methods for more efficient and economical separation of hydrocarbon gas constituents and recovery of both light gaseous hydrocarbons and the heavier hydrocarbon liquids. The present invention provides methods for achieving essentially complete separation and recovery of heavier hydrocarbon liquids. More particularly, the methods of present invention more efficiently and more economically separate ethane, propane, propylene and heavier hydrocarbons liquids from any hydrocarbon gas stream i.e. from natural gas or from gases from refinery or petroleum plants. Additionally, the present invention utilizes a process scheme which can be used for high ethane recovery during ethane recovery mode and high propane recovery during ethane rejection mode of plant operation. Thus, the process scheme proposed under the present invention provides additional flexibility to the plant operator to adjust to market conditions without requiring major process scheme changes.

DESCRIPTION OF THE BACKGROUND

In addition to methane, natural gas includes some heavier hydrocarbons with impurities e.g. carbon dioxide, nitrogen, helium, water and non-hydrocarbon acid gases. After compression and separation of these impurities, natural gas is further processed to separate and recover natural gas liquids (NGL). In fact, natural gas may include up to about fifty percent by volume of heavier hydrocarbons recovered as NGL. These heavier hydrocarbons must be separated from methane to be recovered as natural gas liquids. These valuable natural gas liquid comprises of ethane, propane, butane and other heavier hydrocarbons. In addition to these NGL components, other gases, including hydrogen, ethylene and propylene may be contained in gas streams obtained from refinery or from petrochemical plants.

Processes for separating hydrocarbon gas components are well known in the art. C. Collins, R. J. Chen, and D. G. Elliot have provided an excellent general overview of NGL recovery methods in a paper presented at Gas Tech LNG/LPG Conference 84. This paper, entitled "Trends in NGL recovery for natural and associated gases" was published by Gas Tech, Ltd. of Rickmansworth, England, in the transactions of the conference on pages 287–303. The pre-purified natural gas is treated by well known methods including absorption, refrigerated absorption, adsorption and condensation at cryogenic temperatures down to −175 F. Separation of the lower hydrocarbons is achieved in one or more distillation towers. The columns are often referred to as de-methanizer or de-ethanizer columns. Processes employing a de-methanizer column separate methane and other volatile components from ethane and less volatile components in the purified natural gas liquids. The methane fraction is recovered as purified gas for pipeline delivery. The ethane and less volatile components, including propane, are recovered as natural gas liquid. In some applications, however, it is desirable to minimize the ethane content of the NGL. In those applications ethane and more volatile components are separated from propane and less. volatile components in a column generally called the de-ethanizer column.

Arn NGL, recovery plant design is highly dependent upon the operating pressure of the distillation column(s). At medium to low pressures i.e. 400 Psia or lower, the recompression horsepower requirement (to compress the residue gas to pipeline pressure) will be so high that the process becomes uneconomical. However, at higher pressures the recovery level of the hydrocarbons will be significantly reduced due to the less favorable separating conditions i.e. lower relative volatility inside the distillation column. Prior art has concentrated on operating the distillation columns at a higher pressure i.e. 400 Psia or higher while maintaining the high recovery of liquid hydrocarbons.

Many patents have been directed to methods for improving this separation technology. U.S. Pat. Nos. 4,596,588, 4,171,964, 4,278,457, 4,687,499, 4,851,020 describe relevant processes.

While prior art has been capable of recovering more than 98% of propane, propylene and heavier hydrocarbons during the ethane recovery mode, most of these processes fail to maintain the same recovery when ethane is unwanted i.e. in the ethane rejection mode. In order to achieve these goals for high propane recovery with ethane rejection, some systems have included two towers one operating at a higher pressure and one at a lower pressure.

A significant cost in the NGL recovery processes is related to the refrigeration required to chill the inlet gas. Refrigeration for these low temperature schemes is generally provided by using propane or ethane as refrigerants. Refrigeration is also provided by turboexpander processes as described below. For richer gases, containing a significant quantity of heavy hydrocarbons, a combined turbo-expander and external refrigeration process is the best approach.

In order to achieve the high propane recovery, with ethane rejection, some processes proposed in the prior art involve two tower processes i.e. these processes involve two distillation columns with one (de-methanizer) operating at a lower pressure than the other (de-ethanizer). Traditionally, for such processes four approaches to increase propane recovery have been proposed. The operating pressure of the de-ethanizer may be reduced. This approach often includes a two stage expander design to accommodate the high expansion ratio more efficiently. An alternative approach proposed in U.S. Pat. No. 4,251,249 is to install a separator downstream of the expander. This separator will separate the liquid and vapor from the partially condensed product from expander discharge. The vapor is combined with the residue gas from the de-methanizer and the liquid is sent to the de-ethanizer. However, the propane lost with the vapor from the separator reduces the recovery to 90% only. U.S. Pat. Nos. 4,657,571 and 4,690,702 propose processes which involve utilizing the overhead vapor from the de-ethanizer as a reflux in the packed top section of the de-methanizer. While high propane recovery of the order of 98% is achievable with this system, the increased recycle of methane and ethane increases the size of the de-ethanizer and both condenser and reboiler duties. In a related approach, U.S. Pat. No. 5,568,737 suggests recycling the residue gas stream from residue gas compressor discharge to be used as lean reflux in the upper portion of the de-methanizer.

In a typical cryogenic turbo expansion recovery process for high propane recovery with ethane rejection, a feed stream under pressure is cooled by heat exchange with other streams of the process and / or external sources of refrigeration such as propane compression—refrigeration system. As the gas is cooled, liquid may be condensed and collected in one or more separators as high pressure liquid containing some of the desired C3+ components. Depending upon the richness of the gas and the amount of liquid formed, the high pressure liquid may be expanded to a lower pressure and fractionated. The vaporization occurring during expansion causes a further cooling of the stream. Under certain circumstances pre-cooling the high pressure liquid prior to expansion may be desirable in order to further lower the temperature obtained after expansion. The expanded stream, comprising a mixture of liquid and vapor is fractionated in a distillation column (de-ethanizer). In the column, the expansion cooled stream is distilled to separate residual methane, ethane, nitrogen and other volatile components as overhead vapor product from the C3 components and heavier hydrocarbons obtained as bottom liquid product.

The vapor resulting from the partial condensation can be passed through a work expansion machine and expanded to a lower pressure. At this lower pressure further liquid will be generated from the gas due to partial condensation due to the cooling during expansion process. The expanded stream then enters a lower part of an absorber which operates at a pressure slightly lower than the pressure of operation of the de-ethanizer. In the absorber this expanded stream is contacted with the cold liquids to further knock out the C3 and heavier hydrocarbon components from the expanded stream. The resulting liquid stream obtained as a product from the bottom of the absorber is introduced into the upper section of the de-ethanizer column.

The overhead distillation stream from the de-ethanizer passes in heat exchange relation with the residue gas from the absorber column and is cooled, condensing at least a portion of the distillation stream from the de-ethanizer. The cooled distillation stream then enters the upper section of the absorber where cold liquids contained in the distillation stream contact with the expanded stream as described earlier. Typically the vapor portion of the distillation stream and the vapor overhead product from the absorber combine in a separation section in the upper portion of the absorber to yield a residual methane and ethane rich residue gas.

Prior art proposes to improve the propane recovery by utilizing the propane less lean overhead from the de-ethanizer as a reflux in the de-methanizer column. U.S. Pat. No. 5,771,712 recognizes that the absorber column and the de-ethanizer can be combined in a single column. In the proposed process the absorber is replaced by a reflux separator which separates a partially condensed stream obtained by cooling the side vapor draw obtained from the upper portion of the stripping section of the single column. However, in the proposed process the vapor from the reflux separator is combined with the methane and ethane rich residue gas obtained as the top product from the single column.

As can be seen from the foregoing description, prior art has long sought methods for improving the efficiency and economy of processes for separating and recovering propane and heavier natural gas liquids from natural gas. Accordingly, there has been a long felt but unfulfilled need for more efficient, more economical methods for performing separation.

SUMMARY OF INVENTION

The present invention is directed to processes for the separation of heavier hydrocarbons from a hydrocarbon containing gas under pressure. As mentioned above, prior art proposes several turboexpander processes, which aim at improving the heavy hydrocarbon recovery from a hydrocarbon mixture. Most of these processes involve operating two towers—a de-methanizer and a de-ethanizer.

Accordingly, it is the idea of the present invention to provide a process for separating components of a feed gas containing methane and heavier hydrocarbons, which maximizes the heavy hydrocarbon recovery from a distillation column, along with the ability to use the same process scheme for propane recovery (during ethane rejection mode) and ethane recovery modes of operation.

In carrying out these and other objects of the invention, there is provided, in the broadest sense, a process for cryogenically recovering components of hydrocarbon-containing feed gas in a distillation column, (e.g. a cryogenic distillation column) in which the top reflux (to the distillation column) is generated by processing the side draw obtained from the cryogenic distillation column. The lean reflux is defined as a reflux stream which contains very little of the component to be recovered from the cryogenic distillation column. The lean reflux can be generated by either partially vaporizing a side liquid draw from the cryogenic distillation column or by partially condensing a side vapor draw from the cryogenic distillation column and separating the streams so obtained to yield a lean vapor stream and a liquid stream. The lean vapor stream will then be completely or partially condensed by heat exchange with the residue gas and fed to the top of the cryogenic distillation column as a lean reflux. The liquid stream will be cooled, if required, and then fed to the top of the distillation column as a reflux. The two reflux streams obtained by such a process will have an enhanced separation effect as compared to the reflux used in prior art. This enhanced separation effect will enable the operator to obtain higher C2 or C3 recovery from the cryogenic distillation column by using said process.

The quality of the lean reflux can be further improved by replacing the separation step by a mass transfer step. In this process the side draw from the cryogenic distillation column will be fed to an absorber after cooling or heating the side draw, as appropriate. The absorber is a mass transfer device in which a portion of the side liquid or vapor draw from the distillation column or any similar hydrocarbon stream is contacted with another hydrocarbon stream to generate a lean vapor which can be condensed (partially or completely) by heat exchange with the residue gas from the distillation column to generate a lean reflux for the distillation column. The process involves introducing a partially or completely condensed hydrocarbon feed to the top of the absorber and contacting it with another stream which may be obtained by—withdrawing a vapor stream from the distillation column or by vaporizing a side liquid draw from the distillation column or by partially or completely vaporizing the liquid from the two-phase discharge obtained from the expander or by any such alternative means. The absorber comprises one or more mass transfer stages. A vapor stream, containing very little of component to be recovered, is generated from the top of the absorber. The feeds to the absorber and the conditions of operation of the absorber are so maintained that even though the lean vapor from the absorber contains very little of the component to be recovered but it can still be condensed (completely or partially) easily by heat exchange with the overhead residue gas from the distillation column. The predominant liquid stream obtained by substantially cooling and condensing the lean overhead vapor from the absorber is thereafter introduced to the top of the distillation column as lean reflux. The liquid stream from the bottom of the absorber is also introduced in the top of the distillation column as a reflux.

In one embodiment of the present invention the lean reflux process can be used for enhancing the heavy hydrocarbon recovery from a gas mixture containing methane, ethane, propane and heavier hydrocarbons. In this embodiment the feed gas is cooled and in some cases partially condensed. Any liquid condensed on cooling the gas is removed in a separator and is fed to the distillation column for further fractionation. The vapor from the separator is split into two streams. One stream is sent to the inlet of an expander and is expanded to the pressure of the distillation column. The partially condensed and cooled stream from expander discharge is fed to the middle of the distillation column. The second stream is substantially condensed by heat exchange with the overhead residue gas from the distillation column. This condensed stream is fed to the top of the absorber. A side vapor stream is withdrawn from the distillation column from a stage near the feed stage of the expander discharge stream. This side vapor draw stream is compressed and in some cases cooled to partially condense it and it is then fed to the bottom of the absorber, which contains one or more mass transfer stages. In the absorber, the cold liquid feed from the top knocks out the heavier components from the bottom vapor feed thus yielding a lean overhead. The liquid obtained from the bottom of the absorber is heavier and has a significant amount of ethane and propane and heavier components. This liquid is fed to the middle of the distillation column. The lean vapor from the top of the absorber is substantially cooled and condensed and is fed to the top of the distillation column as lean reflux. The conditions of the absorber and the feeds to the absorber are so maintained that the lean vapor from the absorber contains very little of the components to be recovered. Thus by maintaining these conditions, it will be possible to obtain a lean vapor which can be easily condensed by heat exchange with the top residue gas product and hence providing a lean reflux for the distillation column. Since the reflux stream generated from the lean vapor from the absorber overhead contains very little amount of the components to be recovered, the equilibrium loss (of the components to be recovered) in the residue gas from the upper portion of the distillation column is reduced to a minimum. Thus high recovery of heavier hydrocarbons can be achieved using the present invention.

In another embodiment of the present invention the top feed to the absorber can be obtained by partially or completely condensing the inlet feed gas in addition to or instead of partially or completely condensing the vapor from the expander inlet separator.

In another embodiment of the present invention, a side liquid stream, instead of vapor stream, is withdrawn from the distillation column and is pumped to an exchanger. In the exchanger this liquid stream is heated and in the process is partially or in some cases completely vaporized. The partially (and in some cases completely) vaporized stream forms the bottom feed to the absorber. In the absorber the partially or completely vaporized side liquid draw (from the distillation column) is contacted with a hydrocarbon stream which may be obtained by partially or completely condensing the inlet feed gas or by partially or completely condensing the vapor from the expander inlet separator. Due to the mass transfer effected in the absorber a lean overhead vapor is obtained. The lean vapor from the top of the absorber is substantially cooled and partially or completely condensed by heat exchange with the cold overhead residue gas from the distillation column. This (partially or completely) condensed stream is then fed to the top of the distillation column as lean reflux to achieve high recovery of heavy hydrocarbons.

An additional advantage of the process scheme covered under the present invention is that the same scheme can be used for high ethane recovery and high propane recovery with ethane rejection. Thus the same plant can be operated in an ethane recovery mode and an ethane rejection mode by making minor modifications to stream routing. Thus the process provides ability to obtain high recovery of desired hydrocarbons from a distillation column by using a side liquid or vapor draw from the distillation column as a bottom feed to the absorber which provides lean top reflux for the distillation column. This process can be used to obtain high ethane or propane recovery (with ethane rejection) with added flexibility to switch production targets in response to market conditions.

BRIEF DESCRIPTION OF THE DRAWINGS

The application and advantages of the invention will become more apparent by referring to the following detailed description in connection with the accompanying drawings, wherein.

DETAILED DESCRIPTION OF THE INVENTION

Figure 1:
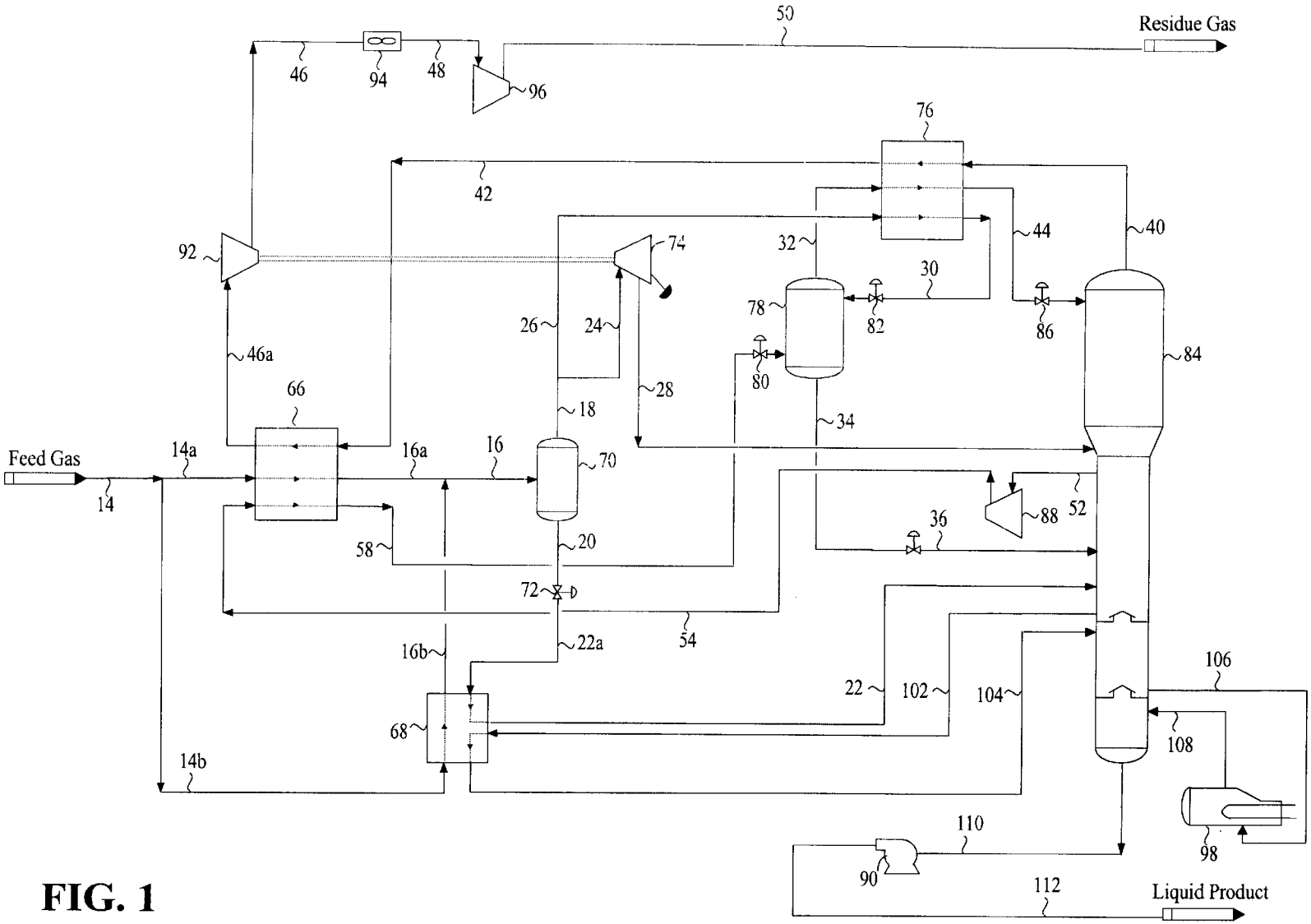
FIG. 1 is a schematic representation of a cryogenic expansion process incorporating the improvements of the present invention.

The present invention permits the separation of ethane, propane, propylene and heavier hydrocarbons from a compressed natural gas or a refinery fuel gas feed. The present invention facilitates high recovery of heavier hydrocarbons by generating a substantial amount of lean reflux stream which can be used in the distillation column as top reflux. This lean reflux stream can be generated by processing a side draw from the cryogenic distillation column. The processing step can include partially vaporizing and separating a side liquid draw or partially condensing and separating a side vapor draw from the cryogenic distillation column. The processing step can also include appropriately heating or cooling the side draw and feeding it to the absorber. The lean reflux is generated in a absorber by contacting the completely or partially vaporized side liquid draw from the distillation column with another partially or completely condensed hydrocarbon stream. This side draw from the distillation column may be a vapor draw or a liquid draw and it forms the bottom feed to the absorber. The leaner top reflux generated in the inventive process permits the operation of the distillation column at a higher pressure, thereby reducing the re-compression horsepower. The generation of the lean reflux does not incur any additional re-compression horsepower as required for residue gas recycle processes mentioned in the prior art.

The additional advantage offered by this scheme is that the same process scheme can be used for both ethane rejection and ethane recovery modes of operation of the plant. Thus the present invention offers an economical way of achieving high heavy hydrocarbon recovery while providing additional flexibility to switch the plant between ethane recovery and ethane rejection mode depending on the market conditions. The term heavy hydrocarbon in this description refers to any hydrocarbon component heavier than methane.

The foregoing merely provides an exemplary description of the use of present invention in a conventional system for processing inlet gas and should not be considered as limiting the methods of the present invention. Various values of temperature, pressure, flow rates, number of stages, feed entry stage number etc. are recited in association with the specific examples described below; those conditions are approximate and merely illustrative, and are not meant to limit the invention. Additionally, for purposes of this invention, when the terms "middle", "top" or "lower" are used with respect to a column or absorber, these terms are to be understood as relative to each other, i.e. that withdrawal of a stream from the "top" of the column is at a higher position than the stream withdrawn from a "lower" portion of the column. When the term "middle" is used it implies that the "middle" section is somewhere between the "upper" and the "lower" section of the column. However, when the terms "upper", "middle" and "lower" have been used with respect to a distillation column it should not be understood that such a column is strictly divided into thirds by these terms.

FIG. 1 illustrates one embodiment of the present invention. The process scheme illustrated in FIG. 1 can be used for obtaining high propane recovery, with ethane rejection, from a mixture of hydrocarbons. Referring to FIG. 1, the feed gas, 14, enters the cryogenic plant at 1100 Psia and 100° F. This dry feed gas has been pretreated as necessary to remove any concentration of sulfur compound, mercury and water. The feed stream 14 is split into two streams 14*a* and 14*b*. Stream 14*a*, which forms 60% of the flow, is fed to the inlet exchanger, 66, where it is cooled and in some cases partially condensed. The resulting product stream, 16*a*, is obtained from the inlet exchanger, 66, at 1° F. The rest of the stream, 14*b*, is fed to the side reboiler, 68. In the side reboiler this stream exchanges heat with the side liquid draw, 102 from the distillation column, 84 and the liquid product, stream 22*a*, from the expander inlet separator, 70. In the side reboiler stream 14*b* is cooled down to 6° F. and the resulting product stream,16*b*, is then mixed with the stream 16*a* from the inlet exchanger, 66. The partially condensed inlet feed gas, stream 16, at 1090 Psia and 3° F. is then sent to the expander inlet separator, 70 where it is separated into a liquid stream, 20 and a vapor stream, 18. The resulting vapor stream, 18, is split into two streams, 26 and 24. Stream 26 forms a very small portion of the total stream 18 (approximately 5.5% in this example). Stream 24, the main vapor portion, is expanded via an expander, 74, to a pressure slightly above the operating pressure of the distillation column, 84. The resulting stream, 28, from expander discharge is obtained at −83° F. and is partially condensed. Stream 28 is fed to the middle section of the distillation column, 84.

Liquid, stream 20, from the expander inlet separator, 70, is expanded to 350 Psia through the control valve, 72. Due to the expansion process the liquid stream, 20 is cooled down. Stream 22*a* from the control valve, 72, discharge is obtained at −45° F. This stream, 22*a*, is then sent to the side reboiler, 68, where it provides refrigeration to a portion of the inlet stream, stream 14*b*. Stream 22, from the side reboiler, 68, is then fed to the middle section of the distillation column, 84.

The remaining portion of the vapor from the expander inlet separator, 70, stream 26, is fed to the reflux exchanger, 76, where it exchanges heat with the cold product residue gas, stream 40, from the top of the distillation column, 84. In the process, stream 26 is condensed (completely in this particular embodiment) to form stream 30. Stream 30, at −85° F. and 1085 Psia is fed to the top of the absorber, 78. The absorber, 78, operates at 350 Psia and hence the top reflux stream, 30, flashes through the control valve, 82 into the absorber.

A side vapor draw, stream 52, is withdrawn from the distillation column, 84. The vapor stream is withdrawn from a stage near the stage at which the expanded stream, 28, from expander, 74, discharge is fed to the distillation column, 84. Stream 52 is withdrawn at 14° F. and 332 Psia. The stage of the side vapor draw is chosen so that the lean vapor, stream 32, from the absorber, 78, contains very small amount of propane and methane and is predominantly ethane. The stream, 52, is then fed to the suction of the blower, 88. The blower compresses the gas to 353 Psia and in the process the gas heats up to 22° F. The compressed vapor stream, 54, is then fed to the inlet exchanger, 66. In the inlet exchanger, 66, stream 54 exchanges heat with the cold overhead residue gas stream, 42, from the reflux exchanger, 76. The side vapor draw stream, 54, is cooled to 0° F. in the inlet exchanger, 66. This partially condensed stream, 58, is then fed to the bottom of the absorber, 78.

It must be noted that, as described in the summary of invention, the feed to the absorber can be obtained as a side vapor draw from the distillation column, 84 (as illustrated in this embodiment) or by partially or completely vaporizing a side liquid draw from the distillation column, 84. This alternate embodiment has been illustrated in FIG. 2. Additionally, the lean reflux can also be generated by partially condensing the side vapor draw from the cryogenic distillation column and separating it in a simple one-stage separator. Similarly the lean reflux can also be generated by partially vaporizing a side liquid draw from the cryogenic distillation column and separating it in a simple one-stage separator. However, the lean reflux generated by such a process will be comparatively less leaner than the lean reflux generated by using a absorber. The advantage of such a process is that the absorber will be replaced by a simpler separation device.

The absorber, 78, may contain one or more mass transfer stages. The absorber, 78 may be any suitable device for separating a bottom liquid stream, 34 and a top vapor product, stream 32, there from. In one non-limiting embodiment of the present invention, the absorber just contains the top absorption section with stream 30 being the top reflux and the bottom feed, 58, being the stripping feed.

In the absorber, 78, the cold top reflux, stream 30, knocks off the heavy hydrocarbons from the bottom feed, stream 58, to produce a leaner overhead vapor product, stream 32. The heavier bottom liquid product from the absorber, stream 34 is obtained at 355 Psia and 0.9° F. This stream is then sent to the middle of the distillation column, 84. Alternately, stream 34 can be either preheated while providing refrigeration for process cooling or sub cooled prior to being sent to the distillation column, 84.

The lean vapor, stream 32, from the top of the absorber, 78, is fed to the reflux exchanger, 76. In the reflux exchanger, 76, the cold overhead residue gas, stream 40, from the distillation column, 84, is used to cool down the lean overhead vapor, stream 32, to −87° F. and forms the top reflux for the distillation column, 84.

Stream 40, from the upper portion of the distillation column, 84, is obtained as a lean residue gas product. This product stream mostly contains methane and ethane and contains very less amount of C3+ hydrocarbons. The stream 40 is then fed to the reflux exchanger, 76, where it exchanges heat with stream 26 and stream 32. In the process the residue gas stream heats up and the hot stream, 42, is obtained at −40° F. and 325 Psia. The stream 42 is then fed to the inlet exchanger, 66, where it provides further refrigeration to the inlet stream, 14*a*, and the side vapor draw, stream 52.

The warm residue gas stream, 46*a*, from the inlet exchanger, 66, is sent to the suction of the expander compressor, 92. The expander compressor, 92, compresses the warm residue gas stream, 46*a*, to 446 Psia. The gas stream from expander compressor discharge, stream 46, is then fed to the air cooler, 94. The cooled stream, 48, from the air cooler, 94, is then fed to the residue gas compressor, 96, which further compresses the gas to the pipeline pressure of 1110 Psia. The hot and compressed residue gas stream, 50, from the compressor, 96, discharge may then either be fed to an air cooler and cooled and fed to a pipeline or the hot gas may be fed to the pipeline as residue gas.

The distillation column, 84, operates at 330 Psia and is a conventional distillation column containing a plurality of mass transfer contacting devices, trays or packing or some combinations of the above. It is typically equipped with one or more liquid draw trays in the lower section of the column to provide heat to the column to strip volatile components off from the bottom liquid product, stream 110. This is accomplished by the use of a side reboiler, 68 and a bottom reboiler,98.

Side liquid draw, stream 102, is withdrawn from the lower portion of the distillation column, 84 and is fed to the side reboiler, 68, where it exchanges heat with a part of the inlet stream, 14*b*. As a result, stream 102 serves to cool down the inlet stream 14*b* in the side reboiler, 68.In the process this stream picks up heat and the hot stream, 104, is sent back to the distillation column, 84. The heat picked up by stream 102 in the side reboiler, 68, provides a part of the reboiler duty of the distillation column, 84.

A portion of the liquid, stream 106, from the bottom section of the distillation column, 84, is withdrawn and sent to the bottom reboiler, 98, for heat exchange. In the bottom reboiler, 98, the liquid stream, 106 resulting in partially vaporized hot stream, 108, from the bottom reboiler is then fed back to the distillation column, 84. In the process the stream, 108, provides heat to the bottom portion of the column, 84, and in the process the lighter more volatile components are stripped off from the bottom liquid product, stream 110. This bottom liquid product contains predominantly C3+ hydrocarbons and is pumped by pump, 90, to downstream storage as NGL product stream, 112.

Table I represents the composition of the major streams along with the performance of the inventive process when applied to high propane recovery with ethane rejection applications:

TABLE I

Composition of major streams and performance of the inventive process

| Stream | Methane | Ethane | Propane | Butane | Total |
|---|---|---|---|---|---|
| 14 | 33983 | 4008 | 1861 | 1224 | 43896 |
| 40 | 33980 | 3972 | 28 | 0.5 | 40804 |
| 110 | 3 | 36 | 1830 | 1223.5 | 3092 |
| 44 | 3687 | 1963 | 76 | 5 | 6398 |

TABLE I-continued

| Description | Invention - FIG. 1 |
|---|---|
| Distillation column pressure, psia | 330 |
| Liquid Recovery | |
| Propane Product, Bbl/Day | 10,909 |
| % Recovery - C3 | 98.33 |
| Residue gas compression, HP | 23029 |

Figure 2:
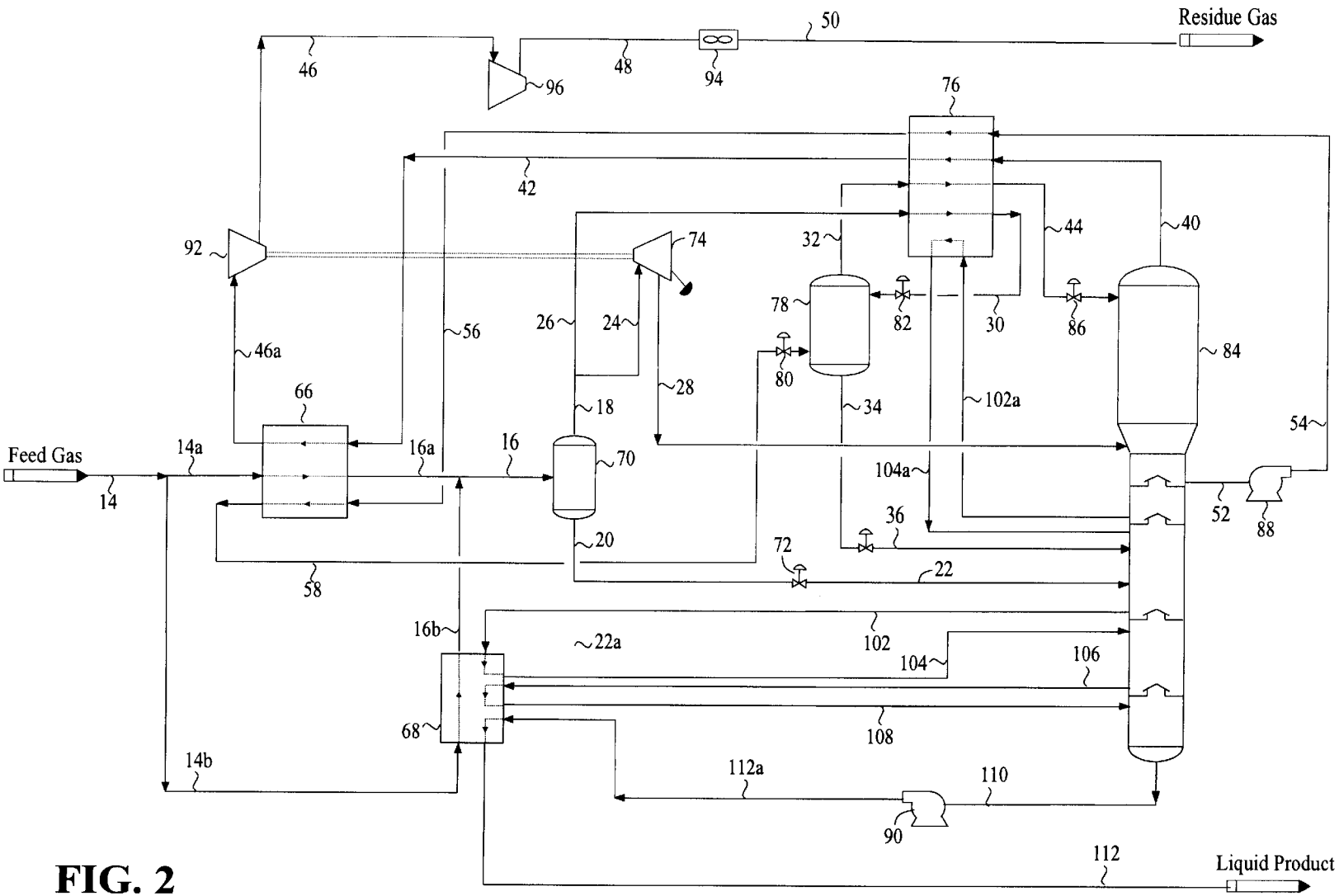
FIG. 2 is alternative arrangement of a cryogenic expansion process incorporating the improvement of the present invention.

The bottom feed to the absorber can also be obtained by taking the side liquid draw from the distillation column and partially vaporizing this side liquid draw stream in the inlet exchangers. This embodiment is illustrated in FIG. 2 which is also an application of the present invention to obtain high ethane recovery from a natural gas stream. The process illustrated in FIG. 2 has some similarity with the process in FIG. 1 thus only the differences between the two processes has been described in detail.

Referring to FIG. 2, the feed gas, 14, is available to the cryogenic plant at 120° F. and 990 Psia. This dry feed gas has been pretreated as necessary to remove any concentration of sulfur compound, mercury and water. Similar to the embodiment illustrated in FIG. 1, the stream 14 is split into two stream 14*a* and 14*b* which are cooled by heat exchange in the inlet exchanger, 66 and side reboiler, 68. The resulting stream, 16, is obtained at 980 Psia and −67° F. Stream 16 is fed to the expander inlet separator, 70 to separate vapor, stream 18 from liquid, stream 20. The resulting vapor stream, 18, is split into two streams, 26 and 24. Stream 26 forms a small portion of the total stream 22 (approximately 24%). Stream 24, which forms the main portion, is expanded to 388 Psia via the expander, 74 and 388 Psia and is fed to the middle section of the distillation column, 84.

Liquid, stream 20, from the expander inlet separator, 70, is expanded through the level control valve, 72 and is then fed to the middle section of the distillation column, 84. Similar to the embodiment shown in FIG. 1, the remaining portion of the vapor from the expander inlet separator, 70, stream 26, is condensed by heat exchange with the cold product residue gas, stream 40, in the reflux exchanger, 76. The resultant stream, 30, is fed to the top of the absorber, 78 at −85° F. and 977 Psia.

A side liquid draw, stream 52, from the middle of the distillation column, 84, is withdrawn at from a few stages above or below the stage at which stream 28 from the expander, 74, discharge is fed to the distillation column, 84. The stage of the side liquid draw is chosen so that the lean vapor, stream 32, from the absorber, 78, contains very small amount of ethane and is predominantly methane. This leaner nature of the lean vapor, stream 32, from the absorber, 78, may make it difficult to condense the vapor in the reflux exchanger, 76, to provide top reflux to the distillation column, 84. Thus, the operating pressure of the absorber is kept high enough so that the lean vapor from the absorber can be partially or completely condensed by heat exchange with the top residue gas product, stream 40, from the distillation column, 84, in the reflux exchanger, 76.

The side liquid draw stream, 52, is fed to the suction of the cryogenic pump, 88, which pumps the side liquid draw stream, 52, to 655 Psia. The liquid stream, 54, from the pump discharge is then fed to the reflux exchanger, 76. In the reflux exchanger, 76, the side liquid draw stream provides refrigeration to cool and condense a portion of stream 26, and the top vapor product from the absorber, stream 32. In the process the side liquid draw stream, 54, is heated up to −90° F. The hot side liquid draw stream, stream 56, is then fed to the inlet exchanger, 66, where it provides refrigeration to a portion of the inlet feed stream, 14a. The hot side liquid draw stream, 56, is heated up to −30° F. in the inlet exchanger, 66. The product stream, 58, is discharged from the inlet exchanger, 66. This partially vaporized stream, 58, is obtained at 648 Psia and −30° F. Stream, 58, is then fed to the bottom of the absorber, 78.

Similar to the embodiment shown in FIG. 1, the top and bottom feeds to the absorber, 78, contact to produce a leaner top vapor product, stream 32. The heavier bottom liquid product from the absorber, stream 34 is fed to the middle of the distillation column, 84. Alternately, stream 34 can be either preheated while providing refrigeration for process cooling or sub cooled prior to being sent to the distillation column, 84.

The lean vapor, stream 32, is obtained at −100° F. and 643 Psia from the top of the reflux absorber, 78. Similar to the embodiment shown in FIG. 1, this stream is cooled and substantially condensed in the reflux exchanger, 76. The resultant, stream, 44, is fed to the top of the distillation column as reflux. In some cases it is possible that additional cold side liquid draws from the distillation column may be required to substantially condense stream 32. As illustrated in FIG. 2, a side liquid draw stream 102*a* is withdrawn from the distillation column, 84, at −132° F. This stream is fed to the reflux exchanger, 76, where it provides refrigeration to condense stream 32 and in the process it picks up heat. The hot stream, 104*a*, is fed back to the distillation column at −130° F. The heat picked up in the process provides a part of the reboiler duty of the distillation column, 84.

Stream 40, from the upper portion of the distillation column, 84, is obtained as a lean residue gas product. This product stream mostly contains methane and contains very less amount of C2+ hydrocarbons. Stream 40 is obtained at 383 Psia and −143° F. and is fed to the reflux exchanger, 76, where it exchanges heat with stream 26 and the top vapor product from the absorber, 78, stream 32. In the process the residue gas stream heats up and the hot stream, 42 is then fed to the inlet exchanger, 66, where it provides further refrigeration to the inlet stream 14*a*.

The warm residue gas stream is compressed and cooled and is fed to the pipeline similar to the embodiment illustrated in FIG. 1. The distillation column, 84, operates at 383 Psia and is a conventional distillation column containing a plurality of mass transfer contacting devices, trays or packing or some combinations of the above. It is typically equipped with one or more liquid draw trays in the lower section of the column to provide heat to the column to strip volatile components off from the bottom liquid product, stream 110. For ethane recovery processes in general the bottom temperatures are cold enough so that the inlet feed gas can be used for providing most of the reboiler duty by heat exchange with side liquid draws from the bottom of the distillation column. This is accomplished by the use of a side reboiler, 68.

Side liquid draw, stream 102, is withdrawn from the distillation column, 84, at 386 Psia and −66° F. The stream, 102, is then fed to the side reboiler, 68, where it exchanges heat with a portion of the inlet stream, 14*b*. As a result, stream 102 serves to cool down the inlet stream 14*b* in the side reboiler, 68. In the process the stream 102 picks up heat and the hot stream, 104, is sent back to the distillation column, 84. The heat picked up by stream 102 in the side reboiler, 68, provides a part of the reboiler duty of the distillation column, 84.

A portion of the liquid, stream 106, from the bottom section of the distillation column, 84, at a temperature of 12° F. is withdrawn and sent to the side reboiler, 68, for heat exchange. In the side reboiler, 68, the liquid stream, 106, is heated to 23° F. The partially vaporized hot stream, 108, from the side reboiler, 68, is then fed back to the distillation column, 84, at 23° F. In the process the stream, 108, provides heat to the bottom portion of the column, 84, and in the process the lighter more volatile components are stripped off from the bottom liquid product, stream 110.

The bottom liquid product, stream 110, is obtained at 23° F. and 388 Psia. This stream is then pumped by the pump, 90, and stream 112*a* from pump discharge is fed to the side reboiler, 68. In the side reboiler stream 112*a* provides refrigeration to a portion of the inlet feed gas, stream 14b. In the process stream 112*a* is heated up to 70° F. Hot stream 112 from the side reboiler, 68, is then sent to storage as product stream. Ethane and heavier components are recovered in the bottom liquid stream while leaving methane and lighter compounds in the top overhead vapor as residue gas.

Table II represents the composition of the major streams and the performance of the inventive process when it is applied to high ethane recovery applications:

TABLE II

Composition of the major streams and performance of the inventive process

| Stream | Methane | Ethane | Propane | Butane | Total |
|---|---|---|---|---|---|
| 14 | 51297 | 4925 | 278 | 5 | 57751 |
| 40 | 51190 | 236 | 0.85 | 0 | 51926 |
| 110 | 107 | 4689 | 276.15 | 5 | 5825 |
| 44 | 14574 | 585 | 12 | 0 | 15450 |

| Description | Invention - FIG. 2 |
|---|---|
| Distillation column pressure, psia | 383 |
| Liquid Recovery | |
| Ethane Product, Bbl/Day | 27,132 |
| % Recovery - C2 | 95.2 |
| Compression, HP | 28,250 |
| Pump, HP | 143 |

Figure 3:
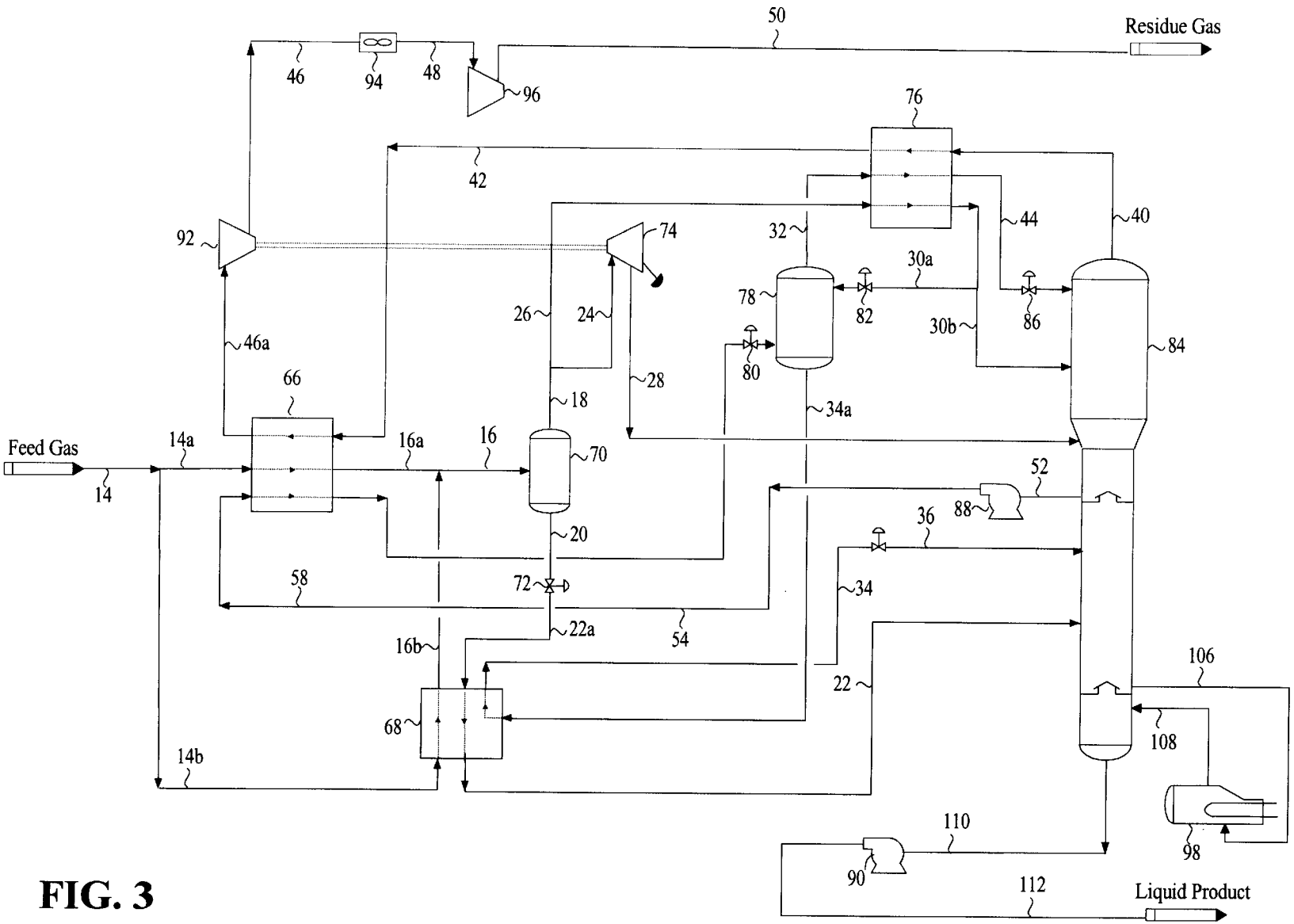
FIG. 3. is another alternative embodiment of a cryogenic expansion process which can be used for high propane recovery with ethane rejection. This process scheme is the same as the scheme illustrated in FIG. 2, thus showing that the same process scheme can be used for high propane recovery with ethane rejection and high ethane recovery modes of operation.

Another embodiment of the present invention is illustrated in FIG. 3. It can be seen that the process scheme in FIG. 3 is very similar to the process scheme in FIG. 2. The embodiment illustrated in FIG. 3 utilizes this process scheme for high propane recovery with ethane rejection, as compared to high ethane recovery mode illustrated in FIG. 2.

Since the processes illustrated in FIG. 3 and 2 are similar, only the main differences have been described in detail.

Referring to FIG. 3, the feed stream 14 is split into two stream 14*a* and 14*b* and is cooled in the inlet exchanger, 66 and the side exchanger, 68. This cold and partially condensed inlet stream, 16, is fed to the expander inlet separator, 70, where the vapor is separated from the liquid.

The liquid, stream 20, from the expander inlet separator, 70, is expanded through the level control valve, 72 and is fed to the side exchanger, 68. In the side exchanger, 68, this stream provides refrigeration to a portion of the inlet feed stream, 14*b*. The hot liquid stream, 22, from the side exchanger, 68, is fed to the middle of the distillation column, 84.

The vapor, stream 18, from the expander inlet separator, 70, is split into two streams, stream 26 and 24. Stream 24, which forms 84% of the total flow, is expanded to 333 Psia. via the expander, 74 and the resultant discharge, stream 28 is fed to the middle of the distillation column, 84. The rest of the vapor from the expander inlet separator, 70, stream 26, is fed to the reflux exchanger, 76. hin the reflux exchanger stream 26 exchanges heat with the cold residue gas, stream 40, from the distillation column, 84. In the process stream 26 is cooled to −84° F. and condensed. The resultant stream 30 from the reflux exchanger, 76, is obtained at 1092 Psia and −84° F. and is split into two stream—30*a* and 30*b*. Stream 30*b*, which forms 74% of the flow, is fed to rectification section of the distillation column, 84, as middle reflux. The rest of the stream 30, stream 30*a*, is fed to the top of the absorber, 78.

As described for the embodiment illustrated in FIG. 2, a side liquid draw, stream 52, is withdrawn from the distillation column, 84 and is then pumped to the inlet exchanger, 66 where it provides refrigeration to cool and condense a portion of the inlet feed stream, stream 14*a*. The side liquid draw stream, 54, is heated up to 66F in the inlet exchanger, 66, and the product stream 58 is discharged from the inlet exchanger, 66. The partially vaporized stream, 58 is then fed to the bottom of the absorber, 78.

Similar to the embodiment shown in FIG. 2, in the absorber, 78, the cold top reflux, stream 30*a*, knocks off the heavy hydrocarbons from the bottom feed, stream 58, and in the process creates a leaner top vapor product, stream 32. The heavier bottom liquid product from the absorber, stream 34*a*, is fed to the side exchanger, 68, where it exchanges heat with the liquid stream, 22*a*. The cooled stream, 34, from the side exchanger, 68, is then fed to the distillation column, 84. In another embodiment of the present invention the bottom liquid product from the absorber can be sent to the distillation column, 84, without cooling it in the side exchanger, 68.

Similar to the embodiment shown in FIG. 2, the lean vapor, stream 32, is condensed in the reflux exchanger, 76. Stream 44 is expanded through the valve 86 and is fed to the top of the distillation column, 84, as top lean reflux.

Stream 40, from the upper portion of the distillation column, 84, is obtained as a lean residue gas product. This product stream mostly contains methane and ethane and contains very less amount of C3+ hydrocarbons. The lean residue gas product, stream 40, from the distillation column, 84 is obtained at 330 Psia and −88° F. Similar to the embodiment shown in FIG. 2, stream 40 provides refrigeration in the reflux exchanger, 76 and in the inlet exchanger, 66.

The warm residue gas stream, 46*a*, is compressed and cooled similar to the embodiment shown in FIG. 2 and is fed to the pipeline as residue gas stream, 50. It is typically equipped with one or more liquid draw trays in the lower section of the column to provide heat to the column to strip volatile components off from the bottom liquid product, stream 110. For the propane recovery (with ethane rejection) case the bottom temperatures is generally higher and hence the side reboilers would not provide the entire reboiler duty for the column, 84. The additional duty for the column is provided by the use of a bottom reboiler, 98.

Stream 110 contains predominantly C3+ hydrocarbons and is pumped by pump, 90 and sent to downstream storage as NGL product, stream 112.

Figure 4:
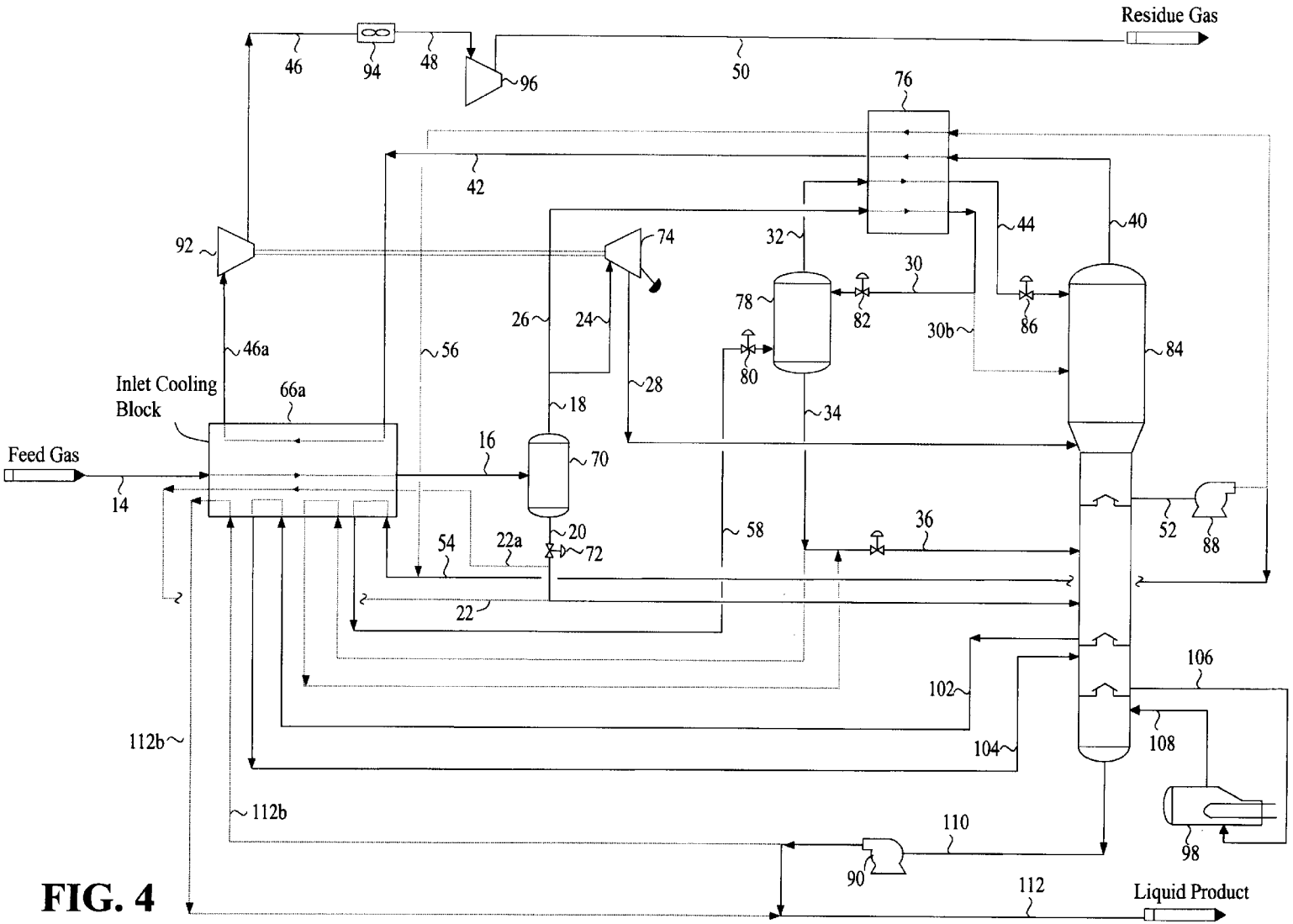
FIG. 4 is another alternate embodiment of the present invention which can be used for high ethane or propane recovery.

FIG. 4 illustrates another embodiment of the present invention. In this embodiment an inlet cooling block has replaced the inlet exchanger and the side reboiler. This does not mean that the inlet cooling block represents specifically one or two exchangers but it implies that the inlet cooling block represents any combination of exchangers, preferably the one that provides the best heat integration in the process. The embodiment illustrated in FIG. 4 can be used for either high recovery of heavy hydrocarbons from a hydrocarbon containing gas.

Referring to FIG. 4, dry feed gas, stream 14, which has been pretreated as necessary to remove any concentration of sulfur compound, mercury and water, is fed to the inlet cooling block where it exchanges heat with the cold residue gas, stream 42, from the top of the distillation column, 84. In addition to the cold residue gas stream, 42, additional streams like the side liquid draw, 102, from the distillation column, 84, liquid stream, 22*a*, from the expander inlet separator, 70, liquid stream, 112*a*, from the bottom of the distillation column, 84, side liquid draw (stream 54 or 56) from the distillation column, 84, or side vapor draw from the distillation column, 84 and others can provide refrigeration in the inlet cooling block, depending upon the process scheme. The cooled and in some cases partially condensed inlet feed gas, stream 16, is fed to the expander inlet separator, 70, where the liquid (if any) is separated from the vapor.

Liquid, stream 20, from the expander inlet separator, 70 is expanded to a pressure slightly above the operating pressure of the distillation column, 84, through the level control valve, 72. In the process the liquid stream flashes and is cooled down. The resultant stream, 22*a*, is fed to middle of the distillation column, 84. Alternately, the liquid stream, 22*a*, is fed to the inlet cooling block, 66*a*. In the inlet cooling block, 66*a*, this stream provides refrigeration to the inlet feed stream, 14, and in the process it heats up. The hot liquid stream, 22, from the inlet cooling block, 66*a*, is then fed to the middle of the distillation column, 84. This alternate scheme has been illustrated by dashed line in FIG. 4.

The vapor, stream 18, from the expander inlet separator, 70, is split into two streams, stream 26 and 24. Stream 24, which forms majority of the total flow, is fed to the suction of the expander, 74. This stream is expanded to a pressure slightly above the operating pressure of the distillation column, 84. The resultant discharge stream, 28, from the expander is fed to the middle of the distillation column, 84.

Similar to the embodiment shown in FIG. 1, the rest of the vapor, stream 26, is subsequently condensed in the reflux exchanger, 76 and is fed to the top of the absorber, 78. In a variation of this scheme at least a portion of stream 30*b* can be fed to the top of the absorber, 78. This alternate scheme has been illustrated by dashed line in FIG. 4.

A side liquid draw, stream 52, from the middle of the distillation column, 84, is withdrawn. The liquid draw is obtained from a few stages above or below the stage at which stream 28 from the expander, 74, discharge is fed to the distillation column, 84. The stage of the side liquid draw is chosen so that the lean vapor, stream 32, from the absorber, 78, contains very little of the component to be removed. Effort is made to keep the lean vapor, stream 32, from the top of the reflux absorber, 78, such that it is easier to condense the vapor in the reflux exchanger, 76. Additionally, the operating pressure of the absorber is kept high enough so that the lean vapor from the absorber can be substantially condensed in the reflux exchanger, 76.

The side liquid draw stream, 52, is then fed to the suction of the cryogenic pump, 88. The cryogenic pump pumps the side liquid draw stream, 52, slightly above the operating pressure of the absorber, 78. The liquid stream, 54, from the pump discharge, is then fed to the inlet cooling block, 66*a*. In the inlet cooling block, 66*a*, the side liquid draw stream provides refrigeration to cool and condense the inlet feed stream, stream 14. The side liquid draw stream, 54, is heated up in the inlet cooling block, 66*a*, and the product stream 58 is discharged from the inlet cooling block, 66*a*. The partially vaporized stream, 58, is then fed to the bottom of the absorber, 78. In some cases, depending upon the temperature, stream 54 may be fed to the reflux exchanger, 76, where it provides part of the refrigeration required to condense streams 26 and 32 and subsequently the hot liquid draw stream, stream 56, is then fed to the inlet cooling block, 66*a* where it provides refrigeration to cool the inlet feed gas, stream 14. This alternate scheme has been illustrated by dashed line in FIG. 4.

It must be noted that in another variation of this invention instead of a side liquid draw, a side vapor draw from the distillation column can be used to produce bottom feed to the absorber, 78 by cooling it or by partially condensing it in some cases.

Similar to the embodiment shown in FIG. 1, in the absorber, 78, the cold top reflux, stream 30, knocks off the heavy hydrocarbons from the bottom feed, stream 58, and in the process creates a leaner overhead vapor, stream 32.

The heavier bottom liquid product from the absorber, stream 34 is then sent to the middle of the distillation column, 84. In some cases the bottom liquid product, stream 34, from the absorber, 78, will be sent to the inlet cooling block, 66*a*, for further heat exchange before being fed to the distillation column, 84. This alternate scheme has been illustrated by dashed line in FIG. 4. The lean vapor, stream 32, from the top of the absorber, 78, is fed to the reflux exchanger, 76, where it is cooled by heat exchange with the top residue gas stream, 40, from the distillation column, 84. In the process, stream 32 is cooled and condensed. The cooled and condensed stream, 44, from the reflux exchanger, 76, is fed to the top of the distillation column, 84, as lean reflux.

Stream 40, from the distillation column, 84, is obtained as a lean residue gas product. This product stream mostly contains light hydrocarbons. Similar to the embodiment shown in FIG. 1, the residue gas stream, 40, provides refrigeration in reflux exchanger, 76 and in the inlet cooling block, 66*a*.

The warm residue gas stream, 46*a*, is compressed and cooled similar to the embodiment shown in FIG. 1 and is fed to the pipeline as residue gas stream, 50. The distillation column, 84, is a conventional distillation column containing a plurality of mass transfer contacting devices, trays or packing or some combinations of the above. It is typically equipped with one or more liquid draw trays in the lower section of the column to provide heat to the column to strip volatile components off from the bottom liquid product, stream 110. This is accomplished by the use of a bottom reboiler, 98. In some instances, side liquid draws from the distillation column, 84, can exchange heat in the inlet cooling block, 66*a*, to provide a portion of the total reboiler duty required. The side and bottom reboiler arrangement, to provide the reboiler duty, is similar to the arrangement shown in embodiments shown in FIG. 1 and FIG. 2.

The bottom liquid product, 110, thus obtained contains very few light components and is pumped by pump 90 to the storage as product stream 112. In some cases if the bottom temperature of the distillation column, 84, is low enough, the product stream can be fed to the inlet cooling block, 66*a*, to provide refrigeration to cool the inlet feed gas. This alternate scheme has been illustrated in FIG. 4 by dashed lines.

In these specifications, the invention has been described with reference to specific embodiments thereof, and has been demonstrated as effective in providing structures and processes for maximizing the recovery of ethane or propane and/or heavier components from a stream containing those components and methane. However, it will be evident that various modifications and changes can be made thereto without departing from the broader spirit or scope of the invention. Accordingly, the specification is to be regarded in an illustrative rather than a restrictive sense. For example, there may be other ways of configuring and/or operating the hydrocarbon gas processing system of the invention differently from those explicitly described herein which nevertheless fall within the scope of the invention. It is anticipated that by routing certain streams differently, or by adjusting operating parameters certain optimizations and efficiencies may be obtained which would nevertheless not cause the system to fall outside of the scope of the present invention. Likewise, it must be noted instead of using a side liquid or a vapor draw from the distillation column, the liquid from the two-phase stream from expander discharge can also vaporized (completely or partially) and fed to the bottom of the absorber to obtain a lean overhead vapor (which can be condensed and used as lean reflux for the distillation column). Thus this and any such alternative means of feeding the absorber to generate a lean reflux, which though they have not been explicitly shown in the illustrations, are also covered with in the scope of this invention.

We claim:

1. A process for recovering relatively less volatile components from a multi-component feed gas, while rejecting relatively more volatile components as a residue gas via a cryogenic distillation column wherein the reflux to said cryogenic distillation column is generated by steps comprising:

i) Obtaining a side draw from said cryogenic distillation column wherein said side draw is selected from the group consisting of:
   a) a side liquid draw;
   b) a side vapor draw;

ii) Processing said side draw to generate a first vapor stream from further separation of said side draw in one or more mass transfer stages; said first vapor stream is lean in relatively less volatile components to be recovered; and iii) Cooling said first vapor stream and then directing said cooled first vapor stream to the top of said cryogenic distillation column as a lean reflux.

2. A process for recovering relatively less volatile components from a multi-component feed gas, while rejecting relatively more volatile components as a residue gas via a cryogenic distillation column wherein the reflux to said cryogenic distillation column is generated by steps comprising:

i) Obtaining a first liquid stream from said cryogenic distillation column via a side liquid draw;

ii) Raising the pressure of said first liquid stream and thereafter vaporizing at least a portion of said first liquid stream by steps that include heating said first liquid stream in one or more exchangers and then separating, in one or more separation stages, said vaporized first liquid stream to generate a first vapor stream and a second liquid stream; and iii) Cooling said first vapor stream and then directing said cooled first vapor stream to the top of said cryogenic distillation column as a lean reflux.

3. The process of claim 2 wherein said separating step further involves contacting said vaporized first liquid stream with a substantially condensed portion of said feed gas.

4. The process of claim 2 wherein said separating step further involves contacting said vaporized first liquid stream with a substantially condensed stream which can be obtained by steps comprising:

i) Cooling said feed gas stream;

ii) Separating said cool feed gas stream into a vapor portion and a liquid portion;

iii) Splitting said vapor portion into at least two portions—a main vapor portion and a first vapor portion;

iv) Cooling and substantially condensing said first vapor portion to obtain said substantially condensed stream.

5. The process of claim 2 further comprises cooling said second liquid stream and directing said cooled second liquid stream to said cryogenic distillation column.

6. A process for recovering relatively less volatile components from a multi-component feed gas, while rejecting relatively more volatile components as a residue gas via a cryogenic distillation column wherein the reflux to said cryogenic distillation column is generated by steps comprising:

i) Obtaining a vap or stream from said cryogenic distillation column via a side vapor draw and thereafter raising the pressure of said vapor stream to form a first vapor stream;

ii) Processing s aid first vapor stream to generate a second vapor stream and a first liquid stream from said first vapor stream; said second vapor stream is lean in relatively less volatile components to be recovered; and iii) Cooling said second vapor stream and then directing said cooled second vapor stream to the top of said cryogenic distillation column as a lean reflux.

7. The process of claim 6 wherein said processing step (ii) further comprises cooling and partially condensing said first vapor stream in one or more heat exchangers and then separating said partially condensed first vapor stream, in one or more separation stages, to generate said second vapor stream and said first liquid stream.

8. The process of claim 6 wherein said processing step (ii) further involves contacting said first vapor stream with a substantially condensed portion of said feed gas.

9. The process of claim 6 wherein said processing step (ii) further involves contacting said first vapor stream with a substantially condensed stream which can be obtained by steps comprising:

i) Cooling said feed gas stream;

ii) Separating said cool feed gas stream into a vapor portion and a liquid portion;

iii) Splitting said vapor portion into at least two portions—a main vapor portion and a first vapor portion; and iv) Cooling and substantially condensing said first vapor portion to obtain said substantially condensed stream.

10. The process of claim 6 further comprising cooling said first liquid stream and directing said cooled first liquid stream to said cryogenic distillation column.

11. An apparatus for recovering relatively less volatile components from a multi-component feed gas, while rejecting relatively more volatile components as a residue gas comprising:

i) A distillation column having a plurality of feed and recovery trays;

ii) Means for introducing a cooled feed gas/condensate into said distillation column at one or more of said feed trays;

iii) Means for withdrawing a side draw from one or more of said recovery trays wherein said side draw can be selected from the group consisting of:

a) a liquid draw;

b) a vapor draw;

iv) A device for increasing the pressure of said side draw;

v) Means for processing said pressurized side draw to generate a first vapor stream from further separation of said pressurized side draw via one or more mass transfer devices; wherein said first vapor stream is lean in relatively less volatile components to be recovered; and vi) A heat exchanger for cooling said first vapor stream to substantial condensation and thereafter directing it to the top of said distillation column as a lean reflux to enhance the recovery of relatively less volatile components.

12. The apparatus of claim 11 wherein said means for processing said pressurized side draw further comprising:

i) A heat exchanger for indirectly exchanging energy from said pressurized side draw to form a partially condensed stream; and ii) A separator for separating said partially condensed stream to generate a first vapor stream which is lean in relatively less volatile less components to be recovered.

13. The apparatus of claim 11 wherein said means for processing said pressurized side draw further comprising:

i) A heat exchanger for indirectly exchanging energy from said pressurized side draw to form a partially condensed stream; and ii) An absorber comprising one or more mass transfer stages wherein said partially condensed stream contacts with a substantially condensed stream obtained from a portion of said feed gas; and thereafter fractionating it into a first vapor stream and a first liquid stream; said first vapor stream is lean in relatively less volatile components to be recovered.

14. The apparatus of claim 13 wherein said substantially condensed stream can be further obtained in an apparatus comprising:

i) A heat exchanger for cooling said feed gas;

ii) A separator for separating said cooled feed gas into a vapor portion and a liquid portion;

iii) A device for splitting said vapor portion into at least two portions—a main vapor portion and a first vapor portion; and iv) A heat exchanger for cooling and substantially condensing said first vapor portion to obtain said substantially condensed stream.

15. A process for recovering relatively less volatile components from a multi-component feed gas, while rejecting relatively more volatile components as a residue gas via a cryogenic distillation column wherein the reflux to said cryogenic distillation column is generated by steps comprising:

i) Obtaining a first liquid stream from said cryogenic distillation column via a side liquid draw;

ii) Vaporizing at least a portion of said first liquid stream by steps that include heating said first liquid stream in one or more exchangers;

iii) Contacting said vaporized first liquid stream with a substantially condensed stream obtained from a portion of said feed gas to generate a first vapor stream which is lean in relatively less volatile components to be recovered; and iv) Cooling said first vapor stream and then directing said cooled first vapor stream to the top of said cryogenic distillation column as a reflux.

16. The process of claim 15 wherein said substantially condensed stream can be obtained by steps comprising:

i) Cool said feed gas stream;

ii) Separating said cooled feed gas stream into a vapor portion and a liquid portion;

iii) Splitting said vapor portion into at least two portions—a main vapor portion and a first vapor portion; and iv) Cooling and substantially condensing said first vapor portion to obtain said substantially condensed stream.

17. A process for recovering relatively less volatile components from a multi-component feed gas, while rejecting relatively more volatile components as a residue gas via a cryogenic distillation column wherein the reflux to said cryogenic distillation column is generated by steps comprising:

i) Obtaining a first vapor stream from said cryogenic distillation column via a side vapor draw;

ii) Contacting said first vapor stream with a substantially condensed stream obtained from a portion of said feed gas to generate a first vapor stream which is lean in relatively less volatile components to be recovered; and iii) Cooling said first vapor stream and then directing said cooled first vapor stream to the top of said cryogenic distillation column as a reflux.

18. The process of claim 17 wherein said substantially condensed stream can be obtained by steps comprising:

i) Cooling said feed gas stream;

ii) Separating said cooled feed gas stream into a vapor portion and a liquid portion;

iii) Splitting said vapor portion into at least two portions—a main vapor portion and a first vapor portion; and iv) Cooling and substantially condensing said first vapor portion to obtain said substantially condensed stream.

* * * * *